US006494140B1

(12) United States Patent
Webster

(10) Patent No.: US 6,494,140 B1
(45) Date of Patent: Dec. 17, 2002

(54) MODULAR ROCKET BOOSTED PENETRATING WARHEAD

(75) Inventor: Frank F. Webster, Orlando, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 0 days.

(21) Appl. No.: 09/295,595

(22) Filed: Apr. 22, 1999

(51) Int. Cl.[7] ..... F42B 12/04; F42B 12/20; F42B 12/62

(52) U.S. Cl. ..... 102/374; 102/393; 102/473; 102/489; 244/3.11

(58) Field of Search ..... 102/293, 374, 102/393, 473, 489; 244/3.11, 3.12

(56) References Cited

U.S. PATENT DOCUMENTS

| | | | | | |
|---|---|---|---|---|---|
| 3,897,730 | A | | 8/1975 | Riparbelli | |
| 3,935,817 | A | | 2/1976 | Riparbelli | |
| 4,131,246 | A | | 12/1978 | Rotmans | |
| 4,327,886 | A | | 5/1982 | Bell et al. | |
| 4,455,943 | A | * | 6/1984 | Pinson | 102/489 |
| 4,463,921 | A | | 8/1984 | Metz | |
| 4,522,356 | A | * | 6/1985 | Lair et al. | 102/489 |
| 4,573,412 | A | | 3/1986 | Lovelace et al. | |
| 4,589,594 | A | | 5/1986 | Kranz | |
| 4,641,801 | A | | 2/1987 | Lynch, Jr. et al. | |
| 4,876,963 | A | | 10/1989 | Deffayet | |
| 4,892,268 | A | | 1/1990 | Peretti et al. | |
| 4,898,342 | A | | 2/1990 | Kranz et al. | |
| 4,960,055 | A | * | 10/1990 | Dieval | 102/489 |
| 4,971,266 | A | | 11/1990 | Mehltretter et al. | |
| 5,022,608 | A | | 6/1991 | Beam | |
| 5,109,774 | A | | 5/1992 | Deffayet | |
| 5,189,248 | A | | 2/1993 | Deffayet et al. | |
| 5,216,611 | A | | 6/1993 | McElreath | |
| 5,596,166 | A | | 1/1997 | Gould | |
| 5,649,488 | A | | 7/1997 | Morrison et al. | |
| 5,907,117 | A | * | 5/1999 | Persson et al. | 102/489 |
| 6,012,393 | A | * | 1/2000 | Tal | 102/517 |

* cited by examiner

*Primary Examiner*—Harold J. Tudor
(74) *Attorney, Agent, or Firm*—Burns, Doane, Swecker & Mathis, LLP

(57) ABSTRACT

A modular boosted penetrator (BPEN) is disclosed that includes a penetrating warhead in tandem with a booster motor. The modular BPEN can also include suitable guidance and control systems. The configuration of the modular BPEN is such that it can function as either a direct strike weapon, or as a launchable submunition, without substantial modification.

18 Claims, 5 Drawing Sheets

MODULAR ROCKET BOOSTED PENETRATING WARHEAD

At least some aspects of this invention were made with Government support under contract no. F08630-92-C-0004. The Government may have certain rights in this invention.

FIELD OF THE INVENTION

The invention relates to boosted projectiles in general. In particular, the present invention relates to a boosted penetrating warhead constructed for use as either a direct-strike weapon, or as a launchable submunition.

BACKGROUND OF THE INVENTION

Warhead assemblies are typically designed for a specific type of target. As such, warhead assemblies can lack sufficient performance capabilities and can be ineffective against certain types of targets. Therefore, warhead assemblies having different sizes and configurations, which are used for attacking different types of targets, are common. These different types of warhead assemblies have different aerodynamics, mass, and mechanical and electrical interfaces with the launch platform. These differences limit the flexibility of the launch platforms to accommodate different weapon configurations, and increase the costs associated with integrating, deploying, and supporting these diverse weapons systems.

One target that is especially difficult to defeat is a fortified buried target, such as a bunker. To defeat such targets, and others, it is critical that the warhead be accurately guided to the correct impact point, and adequately penetrate the target. Conventional boosted projectiles lack the ability to adequately penetrate and/or destroy the intended target with the desired degree of efficiency.

Boosted guided warheads are known in the art. For example, U.S. Pat. No. 4,327,886 to Bell et al. discloses a boosted, self-guided projectile or missile, the disclosure of which is incorporated herein by reference, in its entirety. The missile described by Bell et al. includes an airframe having stability fins as well as steering fins, a steering control system, a radar seeker antenna, a warhead, and a rocket booster. The missile disclosed therein is designed to operate as a ramjet after burnout of the rocket booster. However, the warhead and associated booster construction are not disclosed as being capable of incorporation into different launch vehicles or airframes, as a unit. Also, the warhead is not disclosed as being configured to penetrate a target. Similarly, the booster/ramjet propulsion system is apparently configured to merely deliver the payload to the intended target, not to drive the warhead into the target with increased velocity for maximum penetration.

U.S. Pat. No. 5,649,488 to Morrison et al. discloses a warhead designed for maximum target penetration by use of kinetic energy. The warhead disclosed therein is not designed to be coupled with a booster. Instead, it is carried by a non-boosted re-entry missile. In addition, the warhead is not configured to carry a payload, such as conventional or nuclear explosives.

U.S. Pat. No. 5,022,608 to Beam et al. discloses a "kinetic kill" warhead. The device disclosed by Beam is a guided, boosted kinetic kill warhead. As with the Morrison et al. patent, the kinetic kill warhead does not carry a payload, such as conventional or nuclear explosives. In addition, there is no disclosure by Beam et al. that the boosted warhead is configured for use as a direct-strike weapon, or as a launchable submunition.

SUMMARY OF THE INVENTION

The present invention is directed to providing a modular warhead of a standard size that can be used to attack different types of targets. By providing warhead assemblies with common penetrating warhead, common booster, common guidance, and common control systems to attack different targets, the costs associated with integrating, deploying, and supporting weapon systems which use these assemblies, are greatly reduced.

In addition to realizing the foregoing advantages, exemplary embodiments provide a boosted warhead assembly that achieves improved target penetration and destruction.

Generally speaking, exemplary embodiment, are denoted to a warhead assembly including a modular boosted penetrating warhead configured to carry a payload material, a booster mounted in tandem with the warhead to drive the warhead into a target, a guidance system for guiding the warhead toward the target, and a control system for steering the warhead. The booster, guidance system, and control system can be configured such that the boosted penetrating warhead is capable of use as a direct-launch weapon and as a launchable submunition, without substantial modification.

In exemplary embodiments, the warhead assembly has an outer shroud member with a plurality of folding wings and a plurality of air vanes, a warhead configured to penetrate a target and carry a payload material, the warhead being substantially contained within the outer shroud member, a booster mounted in tandem with said warhead to drive the warhead into the target, a guidance system for guiding said warhead toward the target, and a control system for steering the warhead.

In other exemplary embodiments, a two-stage guided missile assembly is provided with an unmanned, guided air vehicle with a submunition carried within the air vehicle. The submunition can include a warhead configured in accordance with exemplary embodiments described above, and can include means for ejecting the submunition from the air vehicle when the air vehicle is a predetermined distance from the target.

BRIEF DESCRIPTION OF THE DRAWINGS

Other objects and advantages of the present invention will become more apparent to those skilled in the art from reading the following detailed description of preferred embodiments in conjunction with the accompanying drawings, wherein like elements have been designated with like reference numerals, and wherein.

DETAILED DESCRIPTION OF THE PREFERRED EMBODIMENTS

Figure 1:
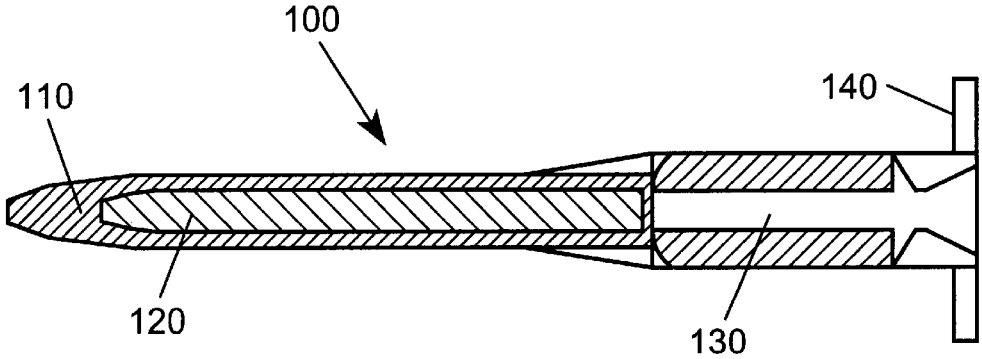
FIG. 1 is a longitudinal sectional view of a modular boosted warhead constructed according to an exemplary embodiment of the present invention.

FIGS. 1–4 illustrate exemplary embodiments of a modular boosted penetrating warhead system (BPEN) 100 constructed according to the principles of the present invention. As illustrated in FIG. 1, major components of the modular BPEN 100 include penetrating warhead 110 and tandem motor, or booster, 130.

The warhead 110 can be formed of a high strength metal, and shaped in any suitable manner that will promote penetration of the intended target. The warhead 110 includes a hollow interior 120 that is configured to carry a payload material (not shown). Suitable payload materials include explosives and agent-defeating materials.

A factor that affects the performance of the warhead 110 is its overall size and weight. Generally speaking, larger warheads can be more effective in penetrating and destroying a target. However, larger warheads have other drawbacks. For example, larger warheads are more difficult to incorporate into an air vehicle as a launchable submunition. Warheads can be made smaller and still possess a high degree of target-defeating ability when boosted to a higher velocity just prior to impact into the target. By way of example, a warhead 110 weighing on the order of approximately 500–650 lbs. is both effective and of suitable size that it can be used as either a direct strike weapon or as a launchable submunition.

Booster motor 130 is attached to the warhead 110. The booster motor 130 can be configured with any type of propulsion system including, for example, a rocket motor. The rocket motor can be powered by a fuel in any suitable form, such as a liquid, solid, gel, or combination thereof, although solid fuels are generally safer for air-carried weapon systems. In an exemplary embodiment, the booster motor 130 can be configured to propel the warhead 110 at a velocity of approximately 2,000 ft./sec., or more with penetration performance increasing at even higher velocity. Upon being driven into the target, the payload material contained in the warhead 110 is activated by a fuze arrangement or other suitable mechanism to destroy the target. The specific construction of the booster motor 130 can be chosen from any number of conventional constructions familiar to those skilled in the art. By way of example only, one such configuration is disclosed in U.S. Pat. No. 5,388,399 to Figge et al., the disclosure of which is incorporated herein by reference.

A modular BPEN 100 constructed according to principles of the present invention can also include guidance and control systems, which enable the modular BPEN 100 to precisely strike the intended target. Several options exist for both guidance and aerodynamic control systems. Guidance can be provided by an inertial navigation system (INS) in conjunction with a global positioning systems (GPS) for target accuracy. Such GPS/INS systems are known to those skilled in the art. By way of example only, such a guidance system is described in U.S. Pat. No. 5,216,611 to McElreath, the disclosure of which is incorporated herein by reference.

Alternatively, a target seeker can be utilized to guide the modular BPEN 100. Target seekers generate a control signal based upon energy received from the target. The construction of such systems are known to those skilled in the art. For example, U.S. Pat. Nos. 5,022,608 and 4,327,886 to Beam and Bell et al., respectively, each disclose a target seeker-type guidance system, and the disclosures of these patents are incorporated herein by reference.

The guidance system can be placed in any suitable location. For example, the guidance system can be housed within a hollow interior of fairings (not shown) which attach between the warhead 110 and the booster motor 130. Alternatively, the guidance system can be mounted to the nose of warhead 110 in a manner known to those skilled in the art.

The modular BPEN can be steered in any suitable manner. For example, the stability air vanes 140 (e.g., FIGS. 1–3A) can be mechanically moved by a conventional air vane control system. For example, U.S. Pat. No. 4,898,342 to Kranz et al. discloses such an air-vane control system, the disclosure of which is incorporated herein by reference.

As an alternative to moveable air vanes, the modular BPEN can be steered by a conventional thrust vector control system. Such systems generally comprise a booster nozzle that is gimbaled in order to steer the weapon. Other examples of thrust vector control steering systems can be found in U.S. Pat. Nos. 4,463,921 and 4,131,246 to Metz and Rotmans, respectively, the disclosures of which are incorporated herein by reference.

Folding wings 150 (e.g. FIGS. 2 and 3B) can be optionally used for additional lift to produce greater range.

Figure 2:
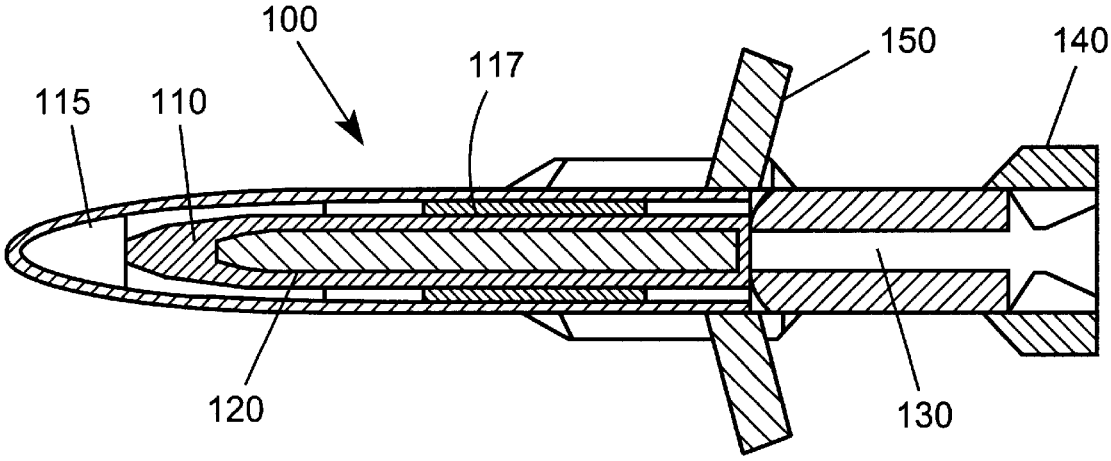
FIG. 2 is a longitudinal sectional view of a modular boosted warhead constructed according to another exemplary embodiment of the present invention.

A combination of the warhead 110, booster motor 130, guidance systems and control system is configured in accordance with exemplary embodiments of the present invention such that the modular BPEN 100 functions as a direct strike weapon, or as a launchable submunition, without substantial modification. In other words modular BPEN 100 can be used in either of the above-mentioned applications without resizing, replacing, or reconfiguring the components of modular BPEN 100. For instance, it may be necessary to provide or modify certain attaching mechanisms of BPEN 100 in order to permit its attachment to a carrying vehicle when used as a direct strike weapon. Configuration of the modular BPEN 100 for use as a direct strike weapon is illustrated in FIG. 2. In this embodiment, a shroud member 115 is fitted over the warhead 110. A lug adapter member 117 can be used to properly locate the warhead 110 within the shroud 115 as well as house lugs for direct mounting to an aircraft. As previously discussed, a booster motor 130 is provided in tandem with the warhead 110. The warhead 110 can be provided with a hollow interior 120 configured to carry a payload of explosives or agent-defeating materials. The modular BPEN 100 can also be provided with guidance and control systems.

Figure 3A:
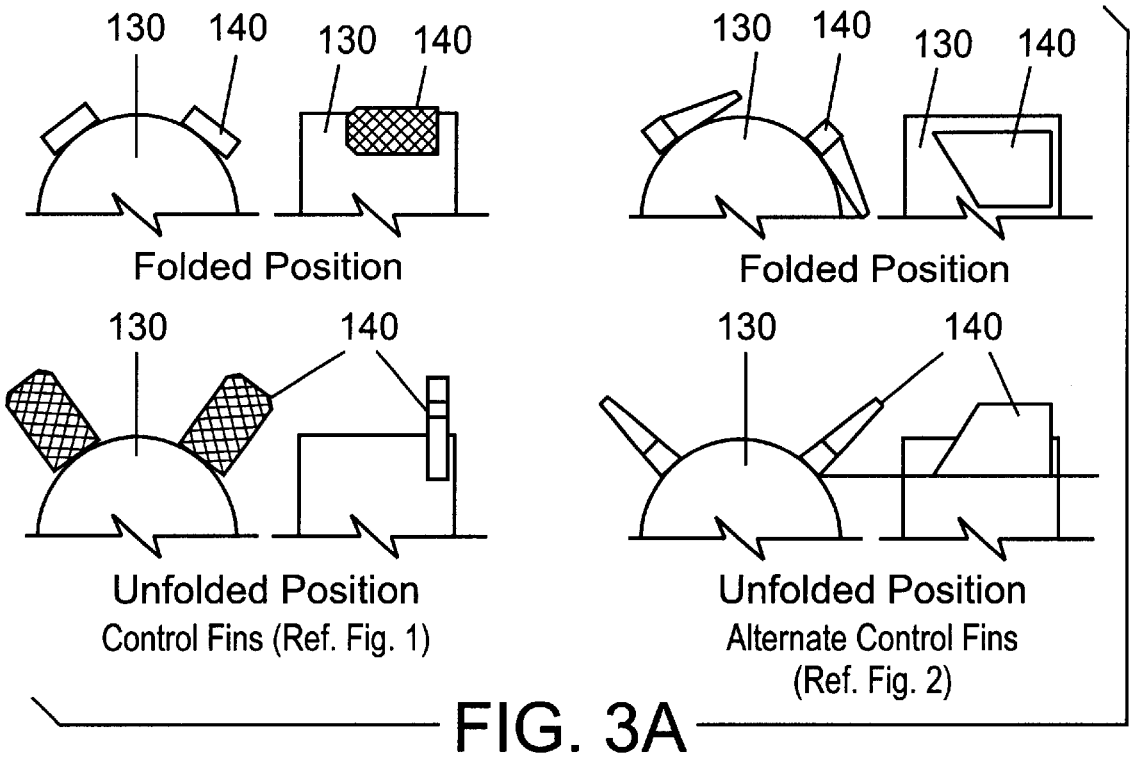
FIG. 3A is a partial view of two exemplary, optional folding air vane constructions of the present invention in a folded, or retracted, condition and in an extended condition.

Air vanes 140 can be used in both the direct strike embodiment and the launchable submunition embodiment. The air vanes can be foldable or otherwise capable of lying in close relationship with the body of the booster motor 130 prior to flight. As illustrated in FIG. 3A, there are multiple options for folding air vanes 140.

Figure 3B:
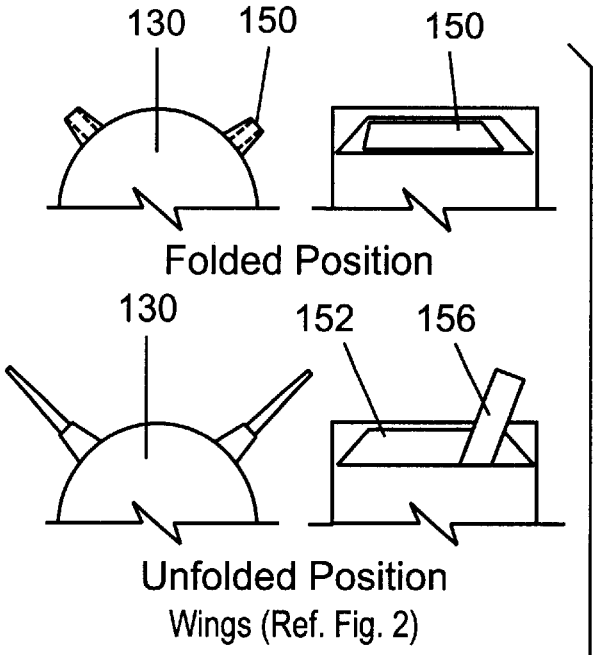
FIG. 3B is a partial view of an exemplary folding wing construction of the present invention in a folded, or retracted, condition and in an extended condition.
Figure 4:
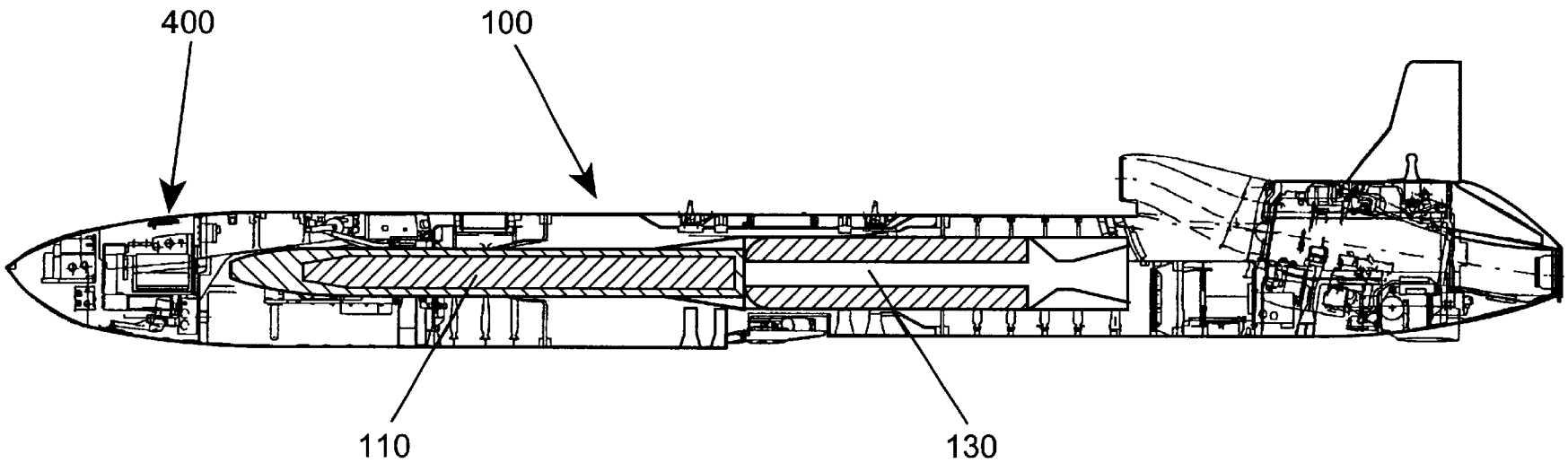
FIG. 4 is a longitudinal sectional view of the modular boosted warhead of FIG. 1 incorporated as a submunition within an unmanned, guided air vehicle.

In the direct strike embodiment, the modular BPEN 100 is provided with a plurality of air vanes 140 and optionally a plurality of wings 150 for stability and maneuverability. The wings 150 can be foldable or otherwise capable of lying in close relationship with the body of modular BPEN 100 prior to flight. As illustrated in FIG. 3B, wings 150 can be of the folding type in which each wing includes a stable base 152 and a foldable end 156. As shown in FIG. 3B, when in the folded state, wings 150 are disposed in close relationship to the body of modular BPEN 100. As shown in FIG. 3B, foldable ends 156 can be moved to form a fully extended wing for stability and maneuverability during flight.

Configuration of the modular BPEN 100 as a launchable submunition in a two-stage guided missile assembly is illustrated in FIGS. 4–6B. In this embodiment, modular BPEN 100 is incorporated into an unmanned, guided air vehicle 400. Any suitable air vehicle 400 can be used. By way of example, air vehicle 400 can be configured as an air-launched "Cruise Missile" (CALCM) of substantially conventional construction. Because more length is required to accommodate the modular BPEN 100 than is currently available in the payload section of a conventional CALCM, fuel and electronic equipment can be moved to other areas to make room for the modular BPEN 100. Of course, air vehicles other than a CALCM can be used as the air vehicle 400. For example, the modular BPEN 100 of the present invention can be incorporated into a "Tomahawk Missile" system or any other similar system.

The modular BPEN 100 of this embodiment includes a penetrating warhead 110 with a booster motor 130 in tandem therewith. The modular BPEN 100 can also include a guidance system for guiding modular BPEN 100 after launch from air vehicle 400. Suitable guidance systems include GPS/INS and target-seeker systems. The modular BPEN 100 further includes a control system, such as a mechanical air vane control system or a thrust vector control system. In this regard, the modular BPEN 100 can include foldable air vanes 140 and/or wings 150 that are collapsed to fit into the air vehicle 400, then extend after the modular BPEN 100 exits the air vehicle 400.

Figure 5:
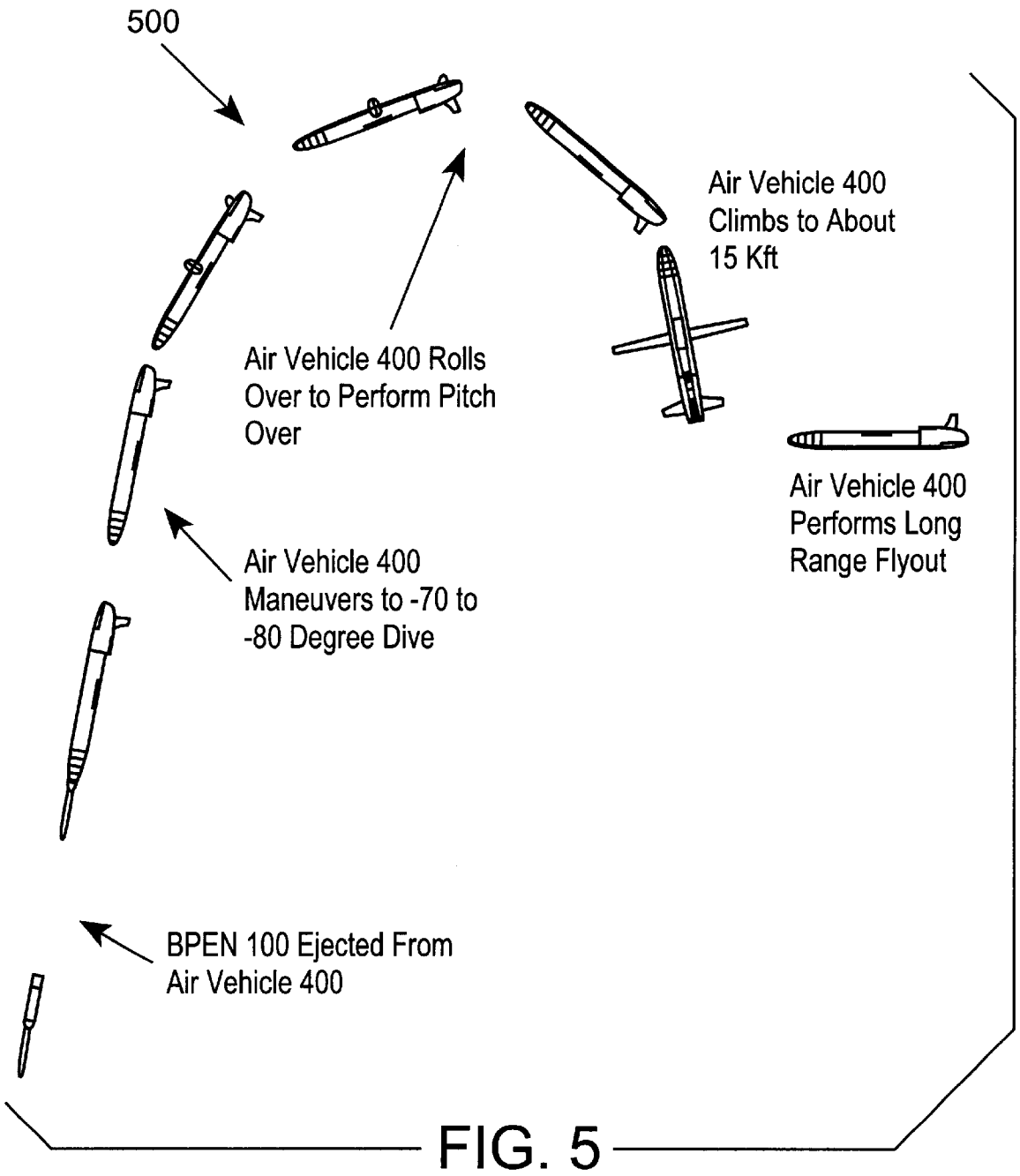
FIG. 5 is a schematic illustration of an exemplary launch of the modular boosted pentrator from the unmanned, guided air vehicle of FIG. 4.
Figure 6A:
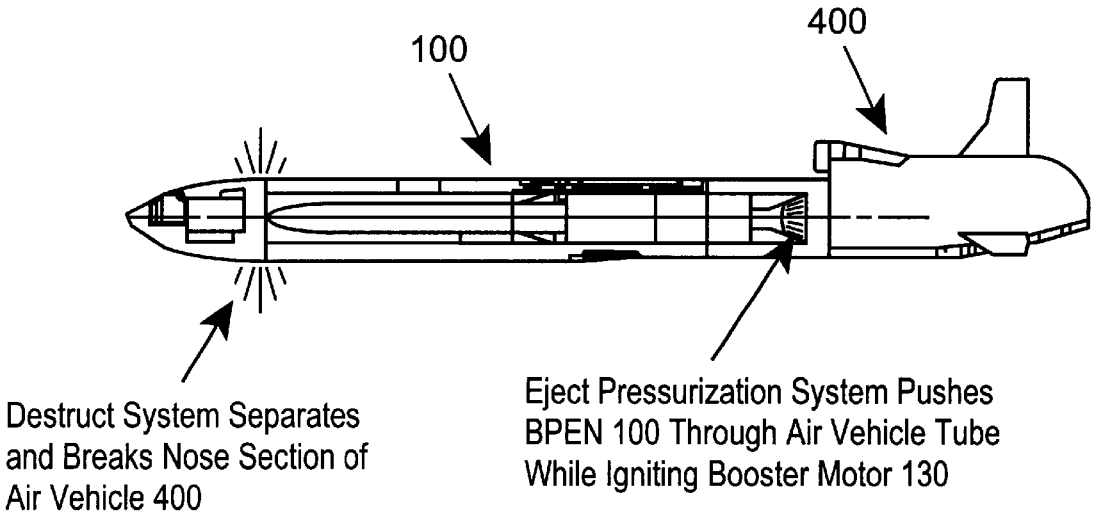
FIG. 6A is a schematic illustration of an exemplary first stage of ejection of a modular boosted warhead from the air vehicle of FIG. 4.
Figure 6B:
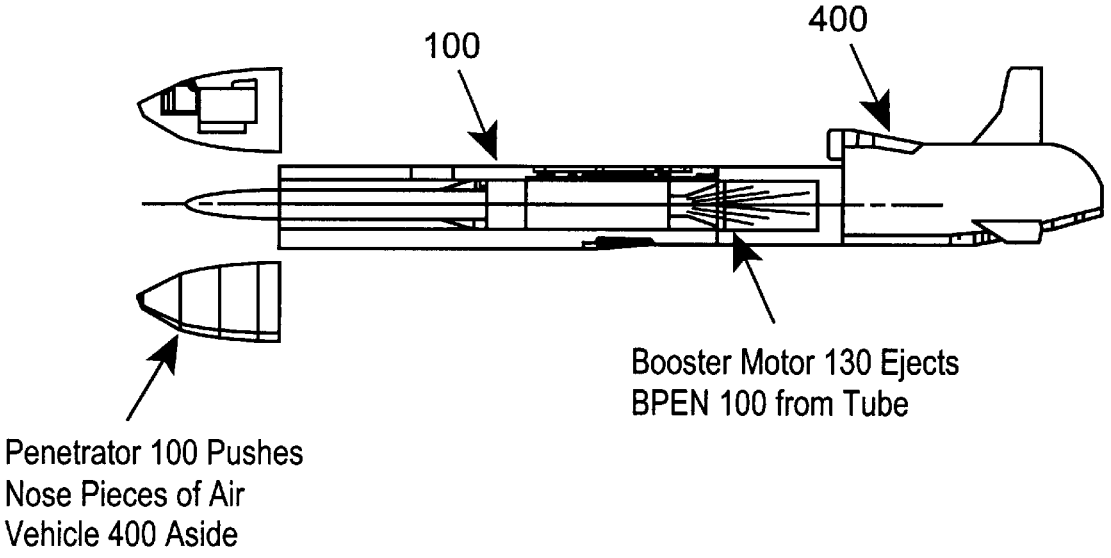
FIG. 6B is a schematic illustration of an exemplary second stage of ejection of a modular boosted warhead from the air vehicle of FIG. 4.

An exemplary operation of this second embodiment will now be described by reference to FIGS. 5–6B.

Target location data is provided to the CALCM and modular BPEN guidance systems prior to launch. As the air vehicle 400 or CALCM approaches the target, a climb is initiated to increase altitude from a relatively low level cruise altitude (e.g., 10,000 ft. or any other specified altitude to around 15,000 ft. or any other specified higher altitude). The air vehicle 400 then rolls and performs a dive toward the target (e.g., a −70 to −80 degree dive). At a set altitude (e.g., about 5,000 ft.) a destructive charge or other suitable destruct mechanism creates an opening in a forward portion of the air vehicle (e.g., separates the nose section of the air vehicle 400 or CALCM as illustrated in FIG. 6A). An eject pressurization system is then activated to push the penetrating warhead 110 through the nose section and ignite the booster motor 130. The booster motor 130 completes ejection of the modular BPEN 100 from the air vehicle 400 or CALCM as illustrated in FIG. 6B. The modular BPEN 100 guidance and control systems then cause the warhead to accurately strike the target at a velocity of approximately 2,000 ft./sec, or more. Upon being driven into the target, the payload material is activated by any suitable conventional manner, such as a fuze arrangement, to effect destruction of the target.

This second embodiment advantageously allows for reduced fuel loading relative to existing CALCM constructions, long range delivery capabilities on the order of 500 km or more, adverse weather effectiveness, and accurate and effective target destruction.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A warhead assembly comprising:

a penetrating warhead comprising a symmetric nose, and a hollow interior configured to carry a payload material extending from a rear end of the warhead to substantially the nose, the penetrating warhead having a weight of approximately 500–650 lbs;

a booster mounted in tandem with said warhead, said booster configured to drive the warhead into a target at a velocity of 2,000 ft./sec., or greater;

a plurality of collapsable vanes configured to lie close to the booster in a first position, and be expandable from the first position to a second expanded position;

a guidance system for guiding said penetrating warhead toward a target object; and a control system for steering said penetrating warhead;

wherein said penetrating warhead, said booster, said guidance system, and said control system being configured such that said warhead assembly can function as a direct-launch weapon and as a launchable submunition, without substantial modification.

2. The system of claim 1, comprising:

means for activating said payload material after said warhead has been driven into said target.

3. The system of claim 1, wherein said booster is a rocket motor powered by a material in a form chosen from the group consisting of: a liquid, a solid, a gel, or a combination thereof.

4. The system of claim 1, wherein said booster comprises a rocket motor powered by solid fuel.

5. The system of claim 1, wherein said guidance system comprises:

a combined Inertial Navigation System/Global Positioning System.

6. The system of claim 1, wherein said guidance system comprises:

a target seeker.

7. The system of claim 1, wherein said control system comprises the collapsable air vanes which are moveable.

8. The system of claim 1, wherein said control system comprises:

a thrust vector control device.

9. A two-stage guided missile assembly comprising:

an unmanned, guided air vehicle; and a submunition carried within said air vehicle, said submunition including:

a penetrating warhead comprising a symmetric nose, and a hollow interior configured to carry a payload material extending from a rear end of the warhead to substantially the nose, the penetrating warhead having a weight of approximately 500–650 lbs;

a booster mounted in tandem with said warhead, said booster configured to drive the warhead into a target object at a velocity of 2,000 ft./sec., or greater;

comprising a plurality of collapsable vanes configured to lie close to the booster in a first position, and be expandable from the first position to a second expanded position;

a guidance system for guiding said submunition toward a target object;

a control system for steering said submunition; and means for ejecting said submunition from said air vehicle when said air vehicle reaches a predetermined distance from a said target; wherein said penetrating warhead, said booster, said guidance system, and said control system being configured such that said submunition can function as a direct launch weapon and as a launchable submunition, without substantial modification.

10. The two-stage guided missile assembly of claim 9, wherein said means for ejecting comprises:

a destruct mechanism that creates an opening in a forward portion of the air; vehicle, and an eject pressurization system that pushes said submunition forward toward said opening.

11. The two-stage guided missile assembly of claim 9, wherein said air vehicle is a cruise missile.

12. The two-stage guided missile assembly of claim 9, comprising:

means for activating said payload material after said warhead has been driven into said target.

13. The two-stage guided missile assembly of claim 9, wherein said booster is a rocket motor powered by a material in a form chosen from the group consisting of: a liquid, a solid, a gel, or a combination thereof.

14. The two-stage guided missile assembly of claim 9, wherein said booster comprises:

a rocket motor powered by solid fuel.

15. The two-stage guided missile assembly of claim 9, wherein said guidance system comprises:

a combined Inertial Navigation System/Global Positioning System.

16. The two-stage guided missile assembly of claim 9, wherein said guidance system comprises:

a target seeker.

17. The two-stage guided missile assembly of claim 9, wherein said control system comprises the collapsable air vanes which are moveable.

18. The two-stage guided missile assembly of claim 9, wherein said control system comprises:

a thrust vector control device.

* * * * *